US010147402B2

(12) United States Patent
Maene

(10) Patent No.: US 10,147,402 B2
(45) Date of Patent: Dec. 4, 2018

(54) INSTRUMENT PROVIDED WITH AN ASSEMBLED SOUNDBOARD

(71) Applicant: Piano's Maene NV, Ruiselede (BE)

(72) Inventor: Chris Maene, Ruiselede (BE)

(73) Assignee: Piano's Maene NV, Ruiselede (BE)

( * ) Notice: Subject to any disclaimer, the term of this patent is extended or adjusted under 35 U.S.C. 154(b) by 39 days.

(21) Appl. No.: 15/590,351

(22) Filed: May 9, 2017

(65) Prior Publication Data

US 2017/0323621 A1 Nov. 9, 2017

(30) Foreign Application Priority Data

May 9, 2016 (BE) ..... 2016/05328

(51) Int. Cl.
*G10C 3/06* (2006.01)

(52) U.S. Cl.
CPC ..... *G10C 3/06* (2013.01)

(58) Field of Classification Search
CPC ..... G10D 3/00; G10D 3/06; G10D 1/00
See application file for complete search history.

(56) References Cited

U.S. PATENT DOCUMENTS

| | | | |
|---|---|---|---|
| 1,377,218 A | 5/1921 | Murdoch | |
| 1,798,212 A | 3/1931 | Loar | |
| 3,311,009 A | 3/1967 | Graves | |
| 5,469,769 A | 11/1995 | Sawada et al. | |
| 9,082,371 B2 * | 7/2015 | Schimmel-Vogel | G10C 1/04 |

FOREIGN PATENT DOCUMENTS

| | | |
|---|---|---|
| DE | 90630 C | 3/1897 |
| EP | 0402948 A2 | 12/1990 |
| NL | 277079 A | 10/1962 |

* cited by examiner

*Primary Examiner* — Kimberly Lockett
(74) *Attorney, Agent, or Firm* — Knobbe, Martens, Olson & Bear, LLP

(57) ABSTRACT

The invention relates to an instrument provided with an assembled soundboard. The nerve structures of the soundboard components are linked to the bass and middle registers on the one hand and the descant on the other hand and are positioned in a different angle with respect to the keyboard. The different positioning of the nerve structures contributes to an improved sound quality, a balanced volume and a warmer timbre. Moreover, such assembled soundboard offers a better resistance to changing weather conditions (i.e. cold and humidity).

18 Claims, 4 Drawing Sheets

INSTRUMENT PROVIDED WITH AN ASSEMBLED SOUNDBOARD

TECHNICAL DOMAIN

The invention relates to a musical instrument, such as a grand piano, provided with an assembled soundboard.

STATE OF THE ART

There is a wide range of musical instruments, wherein a soundboard resonates with the vibrations of strings, with as the best-known example the grand piano. Over the centuries, these instruments have been subject to an important evolution.

Ages ago, one has experimented with parallel strings for grand pianos, that were praised for their clear subdivision into the different registers. However, it was determined that the descant register of such pianos sounds weaker than the bass and middle register because the soundboard is relatively short there. Therefore, nowadays, grand pianos are in a standard way fabricated with crossed strings, with the disadvantage that basses, middle and descant are subdivided less clearly than in case of parallel strings. Because of these crossed strings, it was moreover necessary to position on the one hand the bridge components of the bass register and on the other hand the middle and descant register at a different height, as a result of which the basses are more distant from the soundboard and a part of the vibrations gets lost. The grains of the standard soundboard are positioned in one direction, wherein the bridge components essentially follow the direction of the grains for a homogeneous sound.

Another problem with the existing soundboards is that, in case of humid and dry circumstances, the wood of the soundboard can expand and crimp in the width direction, but not in the longitudinal direction. These soundboards are also susceptible to fluctuations in the environmental temperature, that can lead to bursts in the soundboards.

U.S. Pat. No. 1,798,212 describes a piano comprising a sound box, strings, a soundboard and a bridge, wherein the grain structure of the soundboard is transverse to the bridge. A problem with U.S. Pat. No. 1,798,212 is that the sound is not sufficiently homogeneous, and that there is insufficient resistance to changing weather circumstances.

The present invention aims to find a solution for at least some of the above-mentioned problems.

There is a need for an improved soundboard for musical instruments, such as grand piano's, that offers a clear subdivision of the different registers combined with an equal volume strength and nice timbre of these tonal ranges.

SUMMARY OF THE INVENTION

The invention relates to an instrument provided with an assembled soundboard according to claim 1, wherein the grain structures of the soundboard components linked to the bass and middle register on the one hand and the descant on the other hand are positioned in a different angle with respect to the keyboard.

In a preferred embodiment of the instrument according to the present invention, the bridge comprises several bridge components, wherein a first bridge component supports the strings of the bass register and a second bridge component supports the strings of the middle and descant register, wherein the second bridge component spans over at least half of its length an angle epsilon or theta smaller than 35° with the grain structure of the soundboard components, and preferably spans over at least 60% of its length an angle smaller than 25° with the grain structure of the soundboard components.

The different positioning of the grain structures contributes to an improved sound quality, a balanced volume and a warmer timbre. Moreover, such assembled soundboard offers a better resistance to changing weather conditions (i.e. cold and humidity).

The advantage of a preferred embodiment wherein said second bridge component spans over at least half of its length an angle epsilon or theta smaller than 35° with the grain structure of the soundboard components is that a more homogeneous timbre is provided than is possible with an instrument according to the state of the art. This contrasts with the timbre of a piano according to U.S. Pat. No. 1,798,212, wherein the bridge components are transverse to the grain structure of the soundboard components, with an inhomogeneous sound as a result.

DETAILED DESCRIPTION

Figure 1:
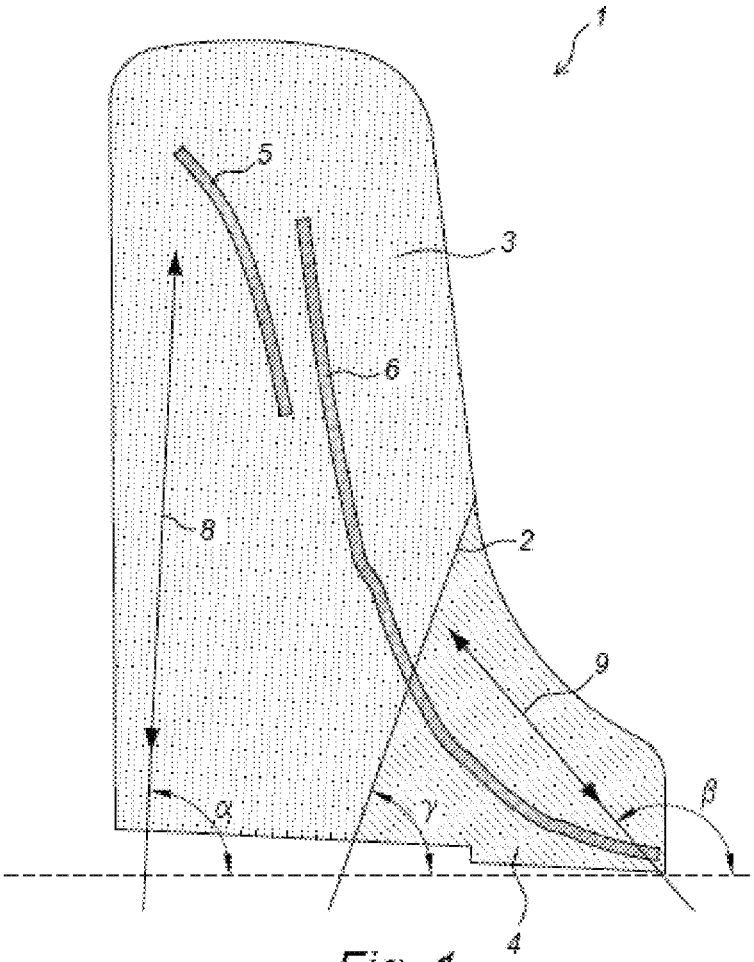
FIG. 1 shows a schematic illustration of an embodiment of an assembled soundboard according to the present invention. Hereby, the positions of the grain structures of the soundboard components, the bridge components and the separation line are illustrated.

The invention relates to a split soundboard for a musical instrument such as a grand piano.

Unless otherwise specified, all terms used in the description of the invention, including technical and scientific terms, shall have the meaning as they are generally understood by the worker in the technical field of the invention. For a better understanding of the description of the invention, the following terms are explained specifically.

A piano is a percussion, keyboard and stringed instrument from the zither family that is played with a single keyboard and 2 or 3 pedals. The piano has large white keys and small black keys. Most pianos have about 88 keys, with an ambitus from A0 to C8 (from "A to C"), i.e. a range of seven octaves plus a small tierce. The number of strings for each piano depends on the scale and can differ among pianos. The strings of a piano are stretched in a cast-iron frame, also called armour plate. The tensile strength of the strings on the cast-iron frame is about 18000 kg for all strings together.

A grand piano is a piano wherein the strings are arranged not in a standing, but in a lying position. Mostly, they are embodied longer and they sound, especially in the low register, clearer, because of a more advantageous length-thickness-tension ratio. The rhythms vary from a small salon piano (1.35 m long) to larger concert grands (longer than 3 m).

The whole range of a piano is subdivided into different subregisters, such as the bass register, the middle/tenor register and the descant tone region. The bass register comprises the tone region from A0 to about D3, the middle register comprises the tone register from about D3 to about A5 and the descant register comprises the tone region from about A5 to C8.

An "agraffe" is a part of some pianos and is mainly applied in grand pianos. The agraffe comprises a close to the tuning pen in the cast-iron frame screwed block and has holes through which (three-chorus) strings pass. Because the agraffe forms a pressure point, the strings can vibrate freely between the bridge and the agraffe itself. The agraffe thus has the same function as a pressure bar.

In a first aspect, the invention relates to an instrument, comprising:

- a keyboard provided with several keys, wherein each key is assigned to one or more strings, wherein said keys and strings are arranged in a bass, middle/tenor and descant register;
- several touch mechanisms, each coupled to one of the keys, appropriate for making the assigned strings vibrate;
- an assembled soundboard, comprising two soundboard components each provided with a grain structure; and
- a bridge, positioned on the soundboard, characterized in that the grain structure of the first soundboard component, assigned to the bass and middle register, is positioned in an angle alpha with respect to the keyboard, and, the grain structure of the second soundboard component, assigned to the descant register, is positioned in an angle beta with respect to the keyboard, wherein alpha and beta are different.

Tests carried out by the inventors have shown that a different orientation of the grain structures of the soundboard components specifically linked to the bass and middle register on the one hand and the descant on the other hand can eliminate the above-described disadvantages of a weaker sounding descant.

Each key comprised in the instrument is preferably assigned to strings of a particular pitch. In higher registers (of e.g. a grand piano), strings are often multiple (two- or three-fold), because these strings sound less strong by nature. Preferably, the strings rest on the bridge, wherein the vibrations of the strings are transferred by the bridge to the soundboard, that resonates with the vibrations. Preferably, the touch mechanisms are composed of one or several hammers and damping systems, such as felt dampers, appropriate for interrupting the vibrations and preventing too loud sounds.

According to another embodiment, the bridge comprises several bridge components, wherein a first bridge component supports the strings of the bass register and a second bridge component supports the strings of the middle and descant register. The strings, that are attached to the frame, rest on one of the bridge components, that pass on the vibrations of the strings onto the soundboard components to which these bridge components are attached. Because two bridge components are provided, one can vary the length, thickness and material of the strings of the bass and middle register. Preferably, the strings of the middle register are thus supported by the bridge component of the middle and descant register, but this middle register is essentially reinforced by the soundboard component of the bass and middle register.

In a preferred embodiment of the present invention, the bridge comprises several bridge components, wherein a first bridge component supports the strings of the bass register and a second bridge component supports the strings of the middle and descant register, wherein the second bridge component spans over at least half of its length an angle epsilon or theta smaller than 35° with the grain structure of the soundboard components, preferably spans over at least 60% of its length an angle smaller than 25° with the grain structure of the soundboard components, more preferably spans over at least 65% of its length an angle smaller than 23°, and still more preferably spans over at least 70% of its length an angle smaller than 20°. The advantage of such an embodiment is the larger homogeneity of the sound by the better adapted contact with the soundboard. Hereby, said length of the second bridge component is defined along the path of the second bridge component. Said path can relate to a linear path, wherein case the angle epsilon or theta with the grain structure is simply the angle between the linear path and the grain structure. In a preferred embodiment however, the second bridge component follows a curvilinear path, and the angle epsilon or theta varies along the path. In case of such a second bridge component, the angle epsilon or theta is defined in a point of the second bridge component as the angle between the grain structure and the tangent line at the path of said point of the second bridge component. Thereby, the angle epsilon relates to the angle with the grain structure of the second soundboard component, while the angle theta relates to the angle with the grain structure of the first soundboard component.

In another preferred embodiment, the bridge comprises several bridge components, wherein a first bridge component supports the strings of the bass register and a second bridge component supports the strings of the middle and descant register, wherein the first bridge component spans over at least half of its length an angle phi smaller than 45° with the grain structure of the soundboard components, preferably the first soundboard component spans over at least 60% of its length an angle smaller than 35° with the grain structure of the soundboard components, more preferably it spans over at least 65% of its length an angle smaller than 30° with the verve structure of the soundboard components, and still more preferably it spans over at least 70% of its length an angle smaller than 25° with the verve structure of the soundboard components. Here too, the advantage of such an embodiment is the larger homogeneity of the sound by the better adapted contact with the soundboard. Hereby, said length of the first bridge component is defined along the path of the first bridge component. This path too can relate to a linear path, wherein case the angle phi is simply the angle between the linear path and the grain structure. In a preferred embodiment however, the first bridge component also follows a curvilinear path, and the angle phi varies along the path. In case of such a first bridge component, the angle phi is defined in a point of the first bridge component as the angle between the grain structure and the tangent line at the path of said point of the first bridge component. Hereby, the angle phi preferably relates to the angle with the grain structure of the first soundboard component.

In a further preferred embodiment, the bridge comprises several bridge components, wherein a first bridge component supports the strings of the bass register and a second bridge component supports the strings of the middle and descant register, wherein the bridge component of the descant register is essentially parallel to the grain structures of the soundboard components. This further contributes to the homogeneity of the sound.

According to another embodiment, the bridge components are positioned in one plane, which is not possible in a grand piano with crossed strings. The distance of the bridge components, and thus the strings, with respect to the soundboard is consequently equal over the complete register of the grand piano, which further contributes to a homogeneous sound.

In an embodiment, the instrument is a grand piano, such as e.g. described in U.S. Pat. No. 1,689,467. A grand piano comprises one or more pedals, a casing (cf. "rim" or "case), a sound box positioned in the casing and a frame provided in the sound box. The strings are attached to the frame and rest on the bridge. Piano "actions", comprised by the touch mechanisms, are mounted in said sound box, appropriate for making the corresponding strings vibrate. The frame is also provided with openings, including sound holes. The bridge, attached to the soundboard, is provided in one of the openings of the frame. The pedals are provided at the proximal end of the grand piano and are positioned close to the base. Preferably, 2, 3 or 4 pedals are provided. At least one of the pedals is used for influencing the timbre or volume (cf. typical left pedal, i.e. "una corda" pedal, or, a middle pedal that is used for damping, i.e. the so-called study pedal). Another pedal can e.g. be a so-called "sostenuto" pedal, as known in the state of the art, or can be provided with means for having all strings resound (typically the right pedal), appropriate for e.g. reinforcing the harmony through resonance of untouched tones, binding tones or chords, suggesting acoustics (reverberation pedal), accentuating tones, etc.

In an embodiment, the angle alpha is between 73° and 103°, preferably between 83° and 93°, more preferably about 88°. Preferably, the strings are essentially positioned perpendicular to the keyboard. Consequently, the strings are about parallel to the grain structure of the soundboard component of the bass and middle register, as a result of which the soundboard can nicely vibrate together with the strings, which has an advantageous effect to the timbre and the distinction between the different tone regions.

According to an embodiment, the angle beta between the grain structure of the second soundboard component and the keyboard is between 115° and 145°, preferably between 120° and 130°, still preferably between 125° and 135°, still more preferably between 126° and 134°, still more preferably between 127° and 133°, still more preferably between 128° and 132°, still more preferably between 129° and 131°, most preferably about 130°. Hereby, the descant part of the bridge component is essentially parallel to the grain structure. The longitudinal direction of the grain structure of the descant part of the soundboard is longer than the corresponding part of a standard grand piano, as a result of which the descant of the grand piano of the present invention sounds stronger. This results in an improved volume balance and an effect on the timbre.

According to an embodiment, the soundboard components are separated by a tangent plane, comprising a separation line in a longitudinal direction that makes an angle gamma with respect to the keyboard. Because the soundboard components touch, vibrations of both components can be transferred. This is necessary, because the second bridge component (middle and descant register) is preferably attached to both soundboard components (as illustrated in the figures). If the soundboard components would not touch, part of the vibrations, and thus part of the volume, would get lost. Moreover, particular strings, positioned above an opening between the soundboard components, would sound less strong, wherein the balance of the grand piano would get lost.

According to a preferred embodiment, the angle gamma is between 45° and 95°, preferably between 55° and 90°, more preferably between 65° and 75°, still more preferably about 70°. As a result of such angle gamma, the separation line starts about at the middle of the keyboard and this separation line ends about halfway the inclined/bent side of the soundboard. Such angle contributes to a good volume balance between the bass and middle register one the one hand and the descant register on the other hand.

According to a preferred embodiment, the tangent plane of the soundboard components at least partially comprises an overlap in a width direction and the tangent plane is in an angle delta with respect to a plane of the soundboard. Such overlap offers a solution for the crimping and expanding of the wooden soundboard under the influence of temperature and humidity fluctuations, as the wood of the soundboard can only expand and crimp in the longitudinal direction, but not in the width direction. Moreover, such overlap contributes to an equal transition of the volume between the bass and middle register on the one hand and the descant register on the other hand.

According to a preferred embodiment, the angle delta is between 150° and 180°, preferably between 160° and 170°, more preferably about 165°. Such angle ensures an optimal transition between both soundboard components.

According to a preferred embodiment, the overlap of the soundboard components extends in the width direction over a distance between 5 cm and 15 cm, preferably about 9 cm. Hereby, the overlap is measured along the second leg of the angle delta (see FIG. 2). Such overlap further contributes to a homogeneous volume and a homogeneous timbre.

According to an embodiment of the present invention, the strings are parallel, which has the advantage that the bass, middle and descant register are clearly subdivided, this is in contrast with the usual grand pianos, wherein the strings of the bass register cross the strings of the middle and descant register. In the past, experiments were carried out with grand pianos with straight wings, wherein the best results were obtained when the grains of the soundboard follow the direction of the strings.

According to another embodiment, the strings of the bass and middle register are parallel to the grain structure of the soundboard component of the bass and middle register, which results in a better vibration together with the soundboard.

According to an embodiment, the bridge component of the descant register is essentially parallel to the grain structures of the soundboard components. This contributes to the homogeneity of the sound. Preferably, the strings of the middle register are also essentially parallel to the grain structure of the soundboard component of the bass and middle register, while the strings of the descant register form an angle with respect to the grain structure of the corresponding soundboard component.

In a preferred embodiment, the grain structure essentially comprises parallel grains, that contribute to a homogeneous sound.

In a preferred embodiment, the soundboard is produced from materials comprising pure quarter Norway spruce. This very fine, straight-grained and elastic Fichte is an optimal kind of wood for fabricating a soundboard. In the length of the grains of the wood, the vibration moves with a speed of about 4500 m/s. In the width of the wood, the vibration moves with a much slower speed, i.e. about 1150 m/s.

In a preferred embodiment, attachment points (so-called "string hitches") are provided for the strings at a proximal and distal end of the instrument. Preferably, also pins (cf. "tuning pins") are provided for tuning the strings. Nowadays, mostly an equal tuning is used for pianos.

In a further preferred embodiment, in the descent register, one attachment point per string is provided, this in contrast to common grand pianos wherein two or more strings are attached around one pin/attachment point. This results in a better attachment of the strings.

In an embodiment, the strings of the bass register comprise brass, while bass strings in grand pianos known from the state of the art are wrapped in copper. The brass does not only reduce the production cost, but also ensures a warm timbre. The other strings are made of materials comprising metals, such as also known from the state of the art. The timbre is further influenced by the positioning of the touch point of the touch mechanism (cf. the hammers).

According to a further aspect of the present invention, which is in no way limiting, the invention relates to the following points.

1. An instrument, comprising:
   - a keyboard provided with several keys, wherein each key is assigned to one or more strings, wherein said keys and strings are arranged in a bass, middle/tenor and descant register;
   - several touch mechanisms, each coupled to one of the keys, appropriate for making the assigned strings vibrate;
   - an assembled soundboard, comprising two soundboard components each provided with a grain structure; and
   - a bridge, positioned on the soundboard, characterized in that the grain structure of the first soundboard component, assigned to the bass and middle register, is positioned in an angle alpha with respect to the keyboard, and, the grain structure of the second soundboard component, assigned to the descant register, is positioned in an angle beta with respect to the keyboard, wherein alpha and beta are different.
2. Instrument according to the previous point 1, characterized in that the instrument is a grand piano, comprising one or more pedals, a casing, a sound box positioned in the casing and a frame provided in the sound box.
3. Instrument according to the previous points 1 to 2, characterized in that the angle alpha is between 73° and 103°.
4. Instrument according to the previous points 1 to 3, characterized in that the angle beta is between 115° and 145°.
5. Instrument according to the previous points 1 to 4, characterized in that the soundboard components are separated by a tangent plane, comprising a separation line in a longitudinal direction that makes an angle gamma with respect to the keyboard.
6. Instrument according to the previous points 5, characterized in that the angle gamma is between 45° and 95°.
7. Instrument according to the previous points 5 and 6, characterized in that the tangent plane of the soundboard components at least partially comprises an overlap in a width direction and the tangent plane is in an angle delta with respect to a plane of the soundboard.
8. Instrument of the previous points 7, characterized in that the angle delta is between 150° and 180°.
9. Instrument according to the previous points 7 to 8, characterized in that the overlap of the soundboard components extends over a distance between 5 cm and 15 cm in the width direction.
10. Instrument according to the previous points 1 to 9, characterized in that the strings are parallel.
11. Instrument according to the previous points 1 to 10, characterized in that the strings of the bass and middle register are parallel to the grain structure of the soundboard component of the bass and middle register.
12. Instrument according to the previous points 1 to 11, characterized in that the bridge comprises several bridge components, wherein a first bridge component supports the strings of the bass register and a second bridge component supports the strings of the middle and descant register.
13. Instrument according to the previous points 12, characterized in that the bridge components are positioned in one plane.
14. Instrument according to the previous points 12 to 13, characterized in that the bridge component of the descant register is essentially parallel to the grain structure of the soundboard components.
15. Instrument according to the previous points 1 to 14, characterized in that the grain structure comprises essentially parallel grains.
16. Instrument according to the previous points 1 to 15, characterized in that the soundboard is fabricated of materials comprising pure quarter Norway spruce.
17. Instrument according to the previous points 1 to 16, characterized in that attachment points for the strings are provided at a proximal and distal side of the instrument.

In the following, the invention will be described by means of non-limiting examples illustrating the invention. These examples are not meant or cannot be interpreted as limiting the scope of the invention.

EXAMPLE

In FIG. 1, an embodiment of an assembled soundboard according to the present invention is shown.

The soundboard (1) comprises two soundboard components (3, 4), separated by a tangent plane (2), comprising a separation line in a longitudinal direction. Said separation line makes an angle gamma with respect to the keyboard of the grand piano, wherein gamma is between 45° and 95°, preferably between 55° and 90°, more preferably between 65° and 75°, still more preferably about 70°. The proximal cutting point of the separation line (2) with the edge of the soundboard is positioned at about A3 with respect to the register (A0-C8) of the piano, or thus about in the middle of the total register. Preferably, this cutting point is situated in a little lower tone region than the middle of the register.

As a result of this separation line, the soundboard better resists to temperature and humidity fluctuations.

The angle alpha ($\alpha$) between the grain structure (8) of the first soundboard component (3) and the keyboard is between 73° and 103°, preferably between 83° and 93°, more preferably about 88°. The angle beta ($\beta$) between the grain structure (9) of the second soundboard component (4) and the keyboard is between 115° and 145°, preferably between 125° and 135°, more preferably about 130°. The bridge further comprises a first component (5) and a second component (6). Hereby, it is important to notice that the bridge components are positioned so that the highest sounding strings from the bass register, coupled to the first bridge component (5), do not cross the lowest sounding strings coupled to the second bridge component (6).

The strings (see FIG. 3), not shown in this figure for clarity reasons, are all parallel, which is a clear difference with the common grand pianos, that comprise crossed strings. The parallel strings ensure a distinct subdivision of the bass register, the middle register and the descant. In the grand pianos according to the present invention, the strings in the bass and middle register are about parallel with the grain structure of the corresponding soundboard component (3).

In the bass and middle register, the grains of the soundboard component (3) essentially follow the direction (8) of the string, but in the descant, the grains of the soundboard component (4) follow the direction (9) of the second bridge component (6). Because the grains of the soundboard wood follow the bridges as much as possible, the grand piano sounds very homogeneous. Moreover, the bridge components (5, 6) are coplanar, i.e. the bridge components are in the same horizontal plane, determined by the cast-iron frame (11). As a result, the strings are at the same height of the soundboard, which ensures a more equal sound and volume.

Figure 2:
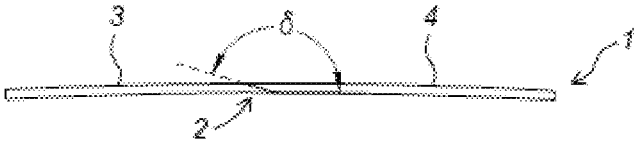
FIG. 2 shows a cross-section of an embodiment of an assembled soundboard, wherein the position of the separation line between the soundboard components with respect to a plane of the soundboard is illustrated.

In FIG. 2, a cross-section of an embodiment of an assembled soundboard is shown, wherein the bridge components (5, 6) are not shown. The soundboard (1) comprises a first soundboard component (3) and a second soundboard component (4), separated by a tangent plane (2). The second soundboard components have an overlap over a distance between 2 cm and 20 cm (cf. the width of the tangent plane), preferably between 5 cm and 15 cm, more preferably about 9 cm. The tangent plane makes an angle delta (δ) with respect to the plane determined by the soundboard, wherein delta is between 150° and 180°, preferably between 160° and 170°, more preferably about 165°.

Figure 3:
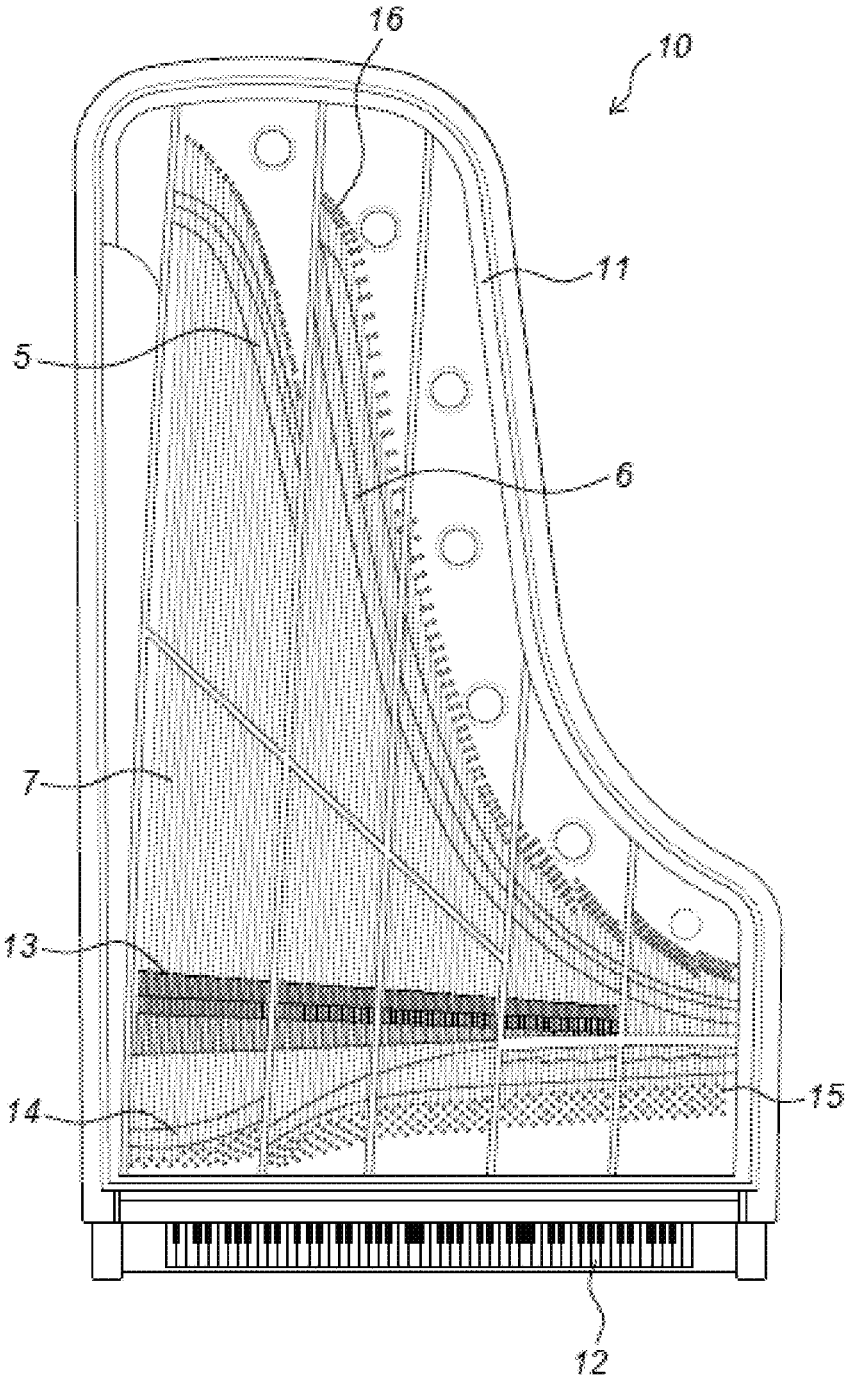
FIG. 3 shows a plan view of an embodiment of a grand piano, wherein the positioning of the bridge components, the strings and the cast-iron frame are illustrated.

In FIG. 3, a plan view of the sound box of a grand piano (10) is shown, provided with a casing, a cast-iron frame (11), a keyboard (12), a touch mechanism (13) and agraffes (14). The cast-iron frame is provided with sound holes and openings wherein the bridge components (5, 6) are positioned. The strings (7) are parallel, stretched over the length of the cast-iron frame and attached by means of attachment pins/attachment points (i.e. string hitch) at the proximal (15) and distal (16) side of the piano. Preferably, one attachment point is provided per string per side in the descant register. In common grand pianos, in practice, two strings are attached around one attachment point. By providing one attachment point per string per side, the strings can be tuned separately in a better/easier way, which is another advantage with respect to the common grand pianos.

Figure 4:
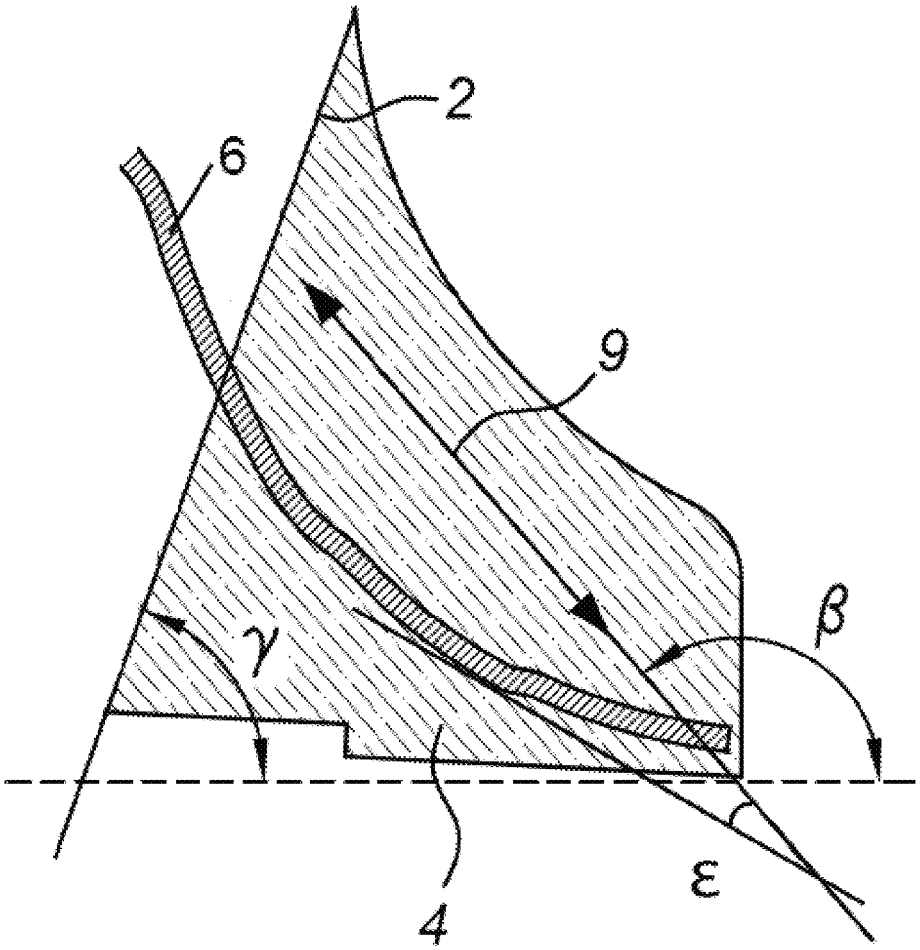
FIG. 4 shows a first detail of FIG. 1. Hereby, the mutual positions of the grain structures of the second soundboard component and the second bridge component are shown in detail.

FIG. 4 shows a first detail of FIG. 1, wherein the mutual positions of the grain structures of the soundboard components and the bridge components are shown in detail. Only the second soundboard component (4) is shown, together with the direction of the grain structure (9) of the second soundboard component (4), and a part of the second bridge component (6). Of the second bridge component (6), the part extending over the second soundboard component (4) is shown completely, while the other part extending over the first soundboard component (3) is shown only partially. Most preferably, the second bridge component (6) is essentially parallel to the grain structures of the second soundboard component (4). Hereby, the second bridge component (6) extends along a curvilinear path and with a particular partial length over the second soundboard component (4). Considering the curvature of the path, the angle between the second bridge component (6) with the second soundboard component (4) varies. This angle, called epsilon (ε), is defined in a point of the second bridge component (4) as the angle between the grain structure of the second bridge component (4) and the tangent line at the path at the level of said point of the second bridge component (6). As the figure illustrates, the second bridge component (6) spans over at least half of said partial length an angle epsilon smaller than 35° with the grain structure of the second soundboard component (4).

Concretely, said angle over more than half of said partial length is even smaller than 15° and this is for particular medial portions even zero.

Figure 5:
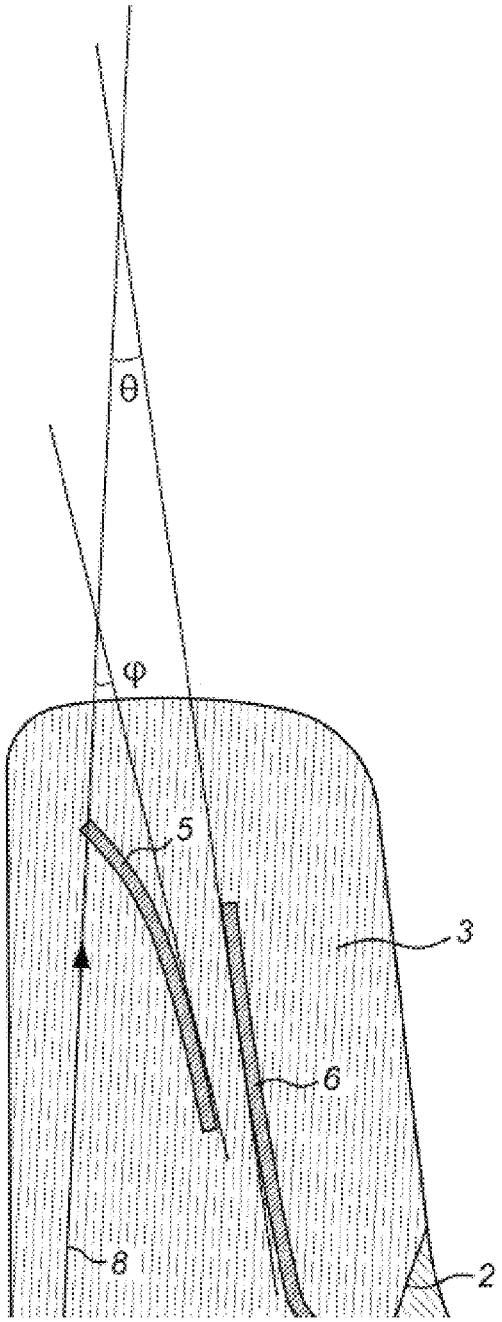
FIG. 5 shows a second detail of FIG. 1. Hereby, the mutual positions of the grain structures of the first soundboard component and both bridge components are shown in detail.

FIG. 5 shows a second detail of FIG. 1. Hereby, the mutual positions of the grain structures of the first soundboard component and both bridge components are shown in detail. The first bridge component (5) is shown as a whole. The second bridge component (6) is partially shown. Furthermore, the relevant part of the first soundboard component (3) is also shown, together with the direction of the grain structure (8) of the first soundboard component (3). Most preferably, the second bridge component (6) is essentially parallel to the grain structures of the first soundboard component (3). Hereby, the second bridge component (6) extends along a curvilinear path and with a particular partial length over the first soundboard component (6). Considering the curvature of the path, the angle between the second bridge component (6) with the first soundboard component (3) varies. This angle, called theta (θ), is defined in a point of the second bridge component (6) as the angle between the grain structures of the first bridge component (3) and the tangent line at the path at the level of said point of the first bridge component. As the figure illustrates, the second bridge component (6) spans over at least half of said partial length an angle epsilon smaller than 35° with the grain structure of the second soundboard component (6). Concretely, said angle over more than half of said partial length is even smaller than 15°. Furthermore, the first bridge component (5) also extends according to a curvilinear path over the first soundboard component (6), and this over its full length. Here too, the angle between the first bridge component (5) with the first soundboard component (3) varies. This angle, called phi (φ), is defined in a point of the first bridge component (5) as the angle between the grain structure of the first bridge component (3) and the tangent line at the path at the level of said point of the first bridge component (5). As the figure illustrates, the first bridge component (5) spans over at least half of said partial length an angle epsilon smaller than 45° with the grain structure of the second soundboard component (6). Concretely, said angle over more than half of said partial length is even smaller than 20°.

FIG. 4 and FIG. 5 together show that the second bridge component (6) is most preferably essentially parallel to the grain structures of both soundboard components (3, 4). Here too, it is clear that small angles epsilon and theta spanning said partial lengths correspond to an angle smaller than 35° with the grain structure of both soundboard components (3, 4) over at least half of the total length of the second bridge component (6).

Below, you will find a list of the numerical references used in the figures.

1 soundboard

2 tangent plane of the soundboard components, including separation lines in longitudinal and width direction

3 soundboard component (bass and middle register)

4 soundboard component (descant)

5 1st bridge component (bass)

6 2nd bridge component (middle and descant)

7 strings

8 direction grain structure of the soundboard (bass and middle register)

9 direction grain structure of the soundboard (descant)

10 grand piano

11 cast-iron frame

12 keyboard

13 touch mechanism system

14 agraffe

15 attachment point strings (proximal side, i.e. the side of the keyboard)

16 attachment point strings (distal side)

It will be clear that the present invention is not limited to the embodiments that have been described above and that some adjustments or modifications can be added to the described examples still falling with the scope of the attached claims.

What is claimed is:

1. An instrument, comprising:

a keyboard provided with several keys, wherein each key is assigned to one or more strings, wherein said keys and strings are arranged in a bass, middle/tenor and descant register;

several touch mechanisms, each coupled to one of the keys, configured to make the assigned strings vibrate;

an assembled soundboard, comprising two soundboard components each provided with a grain structure; and a bridge, positioned on the soundboard, wherein the grain structure of the first soundboard component, assigned to the bass and middle register, is positioned at an angle alpha with respect to the keyboard, and wherein the grain structure of the second soundboard component, assigned to the descant register, is positioned in at angle beta with respect to the keyboard, and wherein alpha and beta are different, and wherein the bridge comprises several bridge components, wherein a first bridge component supports the strings of the bass register and wherein a second bridge component supports the strings of the middle and descant register, and wherein the second bridge component spans over at least half of its length an angle epsilon or theta smaller than 35° with the grain structure of the soundboard components.

2. The instrument of claim 1, wherein the bridge comprises several bridge components, wherein a first bridge component supports the strings of the bass register and wherein a second bridge component supports the strings of the middle and descant register, and wherein the first bridge component spans over at least half of its length an angle phi smaller than 45° with the grain structure of the soundboard components.

3. The instrument of claim 1, wherein the bridge component of the descant register is essentially parallel to the grain structures of the soundboard components.

4. The instrument of claim 1, wherein the bridge components are positioned in one plane.

5. The instrument of claim 1, wherein the instrument is a grand piano, comprising one or more pedals, a casing, a sound box positioned in the casing and a frame provided in the sound box.

6. The instrument of claim 1, wherein the angle alpha is between 73° and 103° and/or the angle beta is between 115° and 145°.

7. The instrument of claim 1, wherein the soundboard components are separated by a tangent plane, comprising a separation line in a longitudinal direction that makes an angle gamma with respect to the keyboard.

8. The instrument of claim 7, wherein the tangent plane of the soundboard components at least partially comprises an overlap in a width direction and the tangent plane is in an angle delta with respect to a plane of the soundboard.

9. The instrument of claim 8, wherein the overlap of the soundboard components extends over a distance between 5 cm and 15 cm in the width direction.

10. The instrument of claim 1, wherein the strings are parallel.

11. The instrument of claim 1, wherein the strings of the bass and middle register are parallel to the grain structure of the soundboard component of the bass and middle register.

12. The instrument of claims 1, wherein the grain structure comprises essentially parallel grains.

13. The instrument of claim 1, wherein the soundboard is fabricated of materials comprising pure quarter Norway spruce.

14. The instrument of claim 1, wherein attachment points for the strings are provided at a proximal and distal side of the instrument.

15. The instrument of claim 1, wherein the second bridge component spans over at least 60% of its length an angle smaller than 25° with the grain structure of the soundboard components.

16. The instrument of claim 2, wherein the first bridge component spans over at least 60% of its length an angle smaller than 35° with the grain structure of the soundboard components.

17. The instrument of claim 7, wherein the angle gamma is between 45° and 95°.

18. The instrument of claim 8, wherein the angle delta is between 150° and 180°.

* * * * *